US006406075B1

(12) United States Patent
Rice et al.

(10) Patent No.: US 6,406,075 B1
(45) Date of Patent: Jun. 18, 2002

(54) LATCH HANDLE ASSEMBLY

(75) Inventors: John R. Rice, Clinton Township; Ronald James Wilde, St. Clair Shores; Lloyd Walker Rogers, Jr., Shelby Township; David A. Sedlak, Clarkston, all of MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/475,373

(22) Filed: Dec. 30, 1999

(51) Int. Cl.[7] ..... E05B 3/00
(52) U.S. Cl. ..... 292/336.3; 70/210
(58) Field of Search ..... 70/208, 210, 257, 70/DIG. 30; 292/336.3, DIG. 31

(56) References Cited

U.S. PATENT DOCUMENTS 2,939,308 A * 6/1960 Trammell ..... 70/210
4,276,459 A * 6/1981 Willett ..... 200/157
4,554,808 A * 11/1985 Escaravage ..... 70/279
5,535,607 A * 7/1996 Dzurko ..... 70/237
6,131,989 A * 10/2000 Montone ..... 296/146.8
6,181,024 B1 * 1/2001 Geil ..... 307/10.2

* cited by examiner

*Primary Examiner*—Gary Estremsky
(74) *Attorney, Agent, or Firm*—Kathryn A. Marra

(57) ABSTRACT

A latch handle assembly for permitting power or manual unlatching of a door latch. The assembly includes a latch handle for manual unlatching of the vehicle door. A mechanical linkage is attached to the latch handle and is adapted to interconnect with the door latch. The latch handle assembly also includes a switch disposed on the latch handle. The switch interconnects with a power-assisted unlatching mechanism that allows the switch to unlatch the door. Finally, there is a handle lock disposed adjacent the latch handle for disabling the latch handle in the normal condition when power is on and the power-assisted unlatching function is operable. The handle lock is operative to move from a locked position preventing the latch handle from moving, and an unlocked position allowing movement of the latch handle.

28 Claims, 10 Drawing Sheets

LATCH HANDLE ASSEMBLY

TECHNICAL FIELD

The present invention relates to vehicle door latches, and more particularly to vehicle door latches having power-assisted unlatching.

BACKGROUND OF THE INVENTION

Power unlatching is by now fairly well-established, having been used for several years on luxury and sport vehicles. The power unlatching mechanism typically includes a motor-operated linkage that acts on the fork bolt detent, causing the detent to disengage the fork bolt and allow the fork bolt to rotate from a latched position to an unlatched position. The mechanism also includes an exposed door switch that allows a person to effect unlatching simply by manipulating the switch.

This power unlatching has the advantage that a person can lock the latch simply by interrupting power. If there is no power supply, the latch cannot unlatch even if a person attempts to operate the switch. Child security is similarly easy to effect because the driver can simply interrupt power to the rear inside door switch, and thereby prevent a child seated in the rear seat from unlatching the latch through manipulation of the switch.

The challenge for these systems is to find a suitable way to provide manual door unlatching in the event of a power failure. Various ways have already been devised. In one case, the doors have inside latch handles with a given amount of travel. The power unlatching switch is associated with the handle such that the switch can be manipulated—and the latch unlatched—when someone pulls the handle through the first portion of its travel. If the vehicle's power is functioning, a person can thus effect power unlatching by pulling the handle through the first portion of the travel. But if power fails, the person can unlatch the door manually by continuing to pull the handle through the remaining portion of its travel. This action will move a mechanical linkage that eventually moves the fork bolt detent to allow the fork bolt to rotate to its unlatched position. These latch handles have been used on the inside and outside of the vehicle doors.

One shortcoming with this arrangement arises because the dual action of the unlatching handle (i.e. power and manual) is not as user-friendly as it could be. People operating the handle are not always aware of this dual action, and they tend to pull on the handle with substantial force, expecting that it has only manual action. Of course, only a minimal force is needed in the first portion of the travel, and so the substantial force from the operator is inappropriate. The experience of pulling strongly on a handle that offers no resistance can be mildly jarring and otherwise unsatisfactory for the operator.

Also, this type of latch is impossible to implement in a child security lock situation. Even if one tried to effect the child security feature by cutting electrical power to the rear inside door switch, the child could still manually unlatch the latch by pulling the handle through the remainder of the its travel.

Accordingly, some new arrangement is necessary both to provide a more pleasing action for the operator, and to facilitate the need for a child security lock in connection with power unlatching door latches.

SUMMARY OF THE INVENTION AND ADVANTAGES

The present invention overcomes the challenges of the prior art by providing an effective and user-friendly way to manually open doors normally unlatched with a power unlatching mechanism when the power fails. The invention is especially useful for manual unlatching of a door whose operation is affected by a child security lock.

According to the invention, the latch handle assembly includes the following basic features. First, there is a support structure adapted to attach to a vehicle door, and a latch handle for manual unlatching of the vehicle door pivotally supported on the support structure between a neutral position and a manual unlatching position. A mechanical linkage is attached to the latch handle and is adapted to interconnect with the door latch for translating motion from the latch handle to the door latch to unlatch the door when the latch handle moves to the unlatching position. The latch handle assembly also includes a switch disposed on the latch handle that is operable to move from a rest position to a power-unlatching position. The switch is adapted to interconnect with the power-assisted unlatching mechanism to allow the switch to unlatch the door when the switch moves to the power-unlatching position. Finally, there is a handle lock disposed adjacent the latch handle. The handle lock is operative to move from a locked position preventing the latch handle from moving to the manual unlatching position, and an unlocked position allowing movement of the latch handle to the manual unlatching position.

FIGURES IN THE DRAWINGS

The present invention will now be described, by way of example, with reference to the accompanying drawings, in which.

DESCRIPTION OF THE PREFERRED EMBODIMENT

Figure 1A:
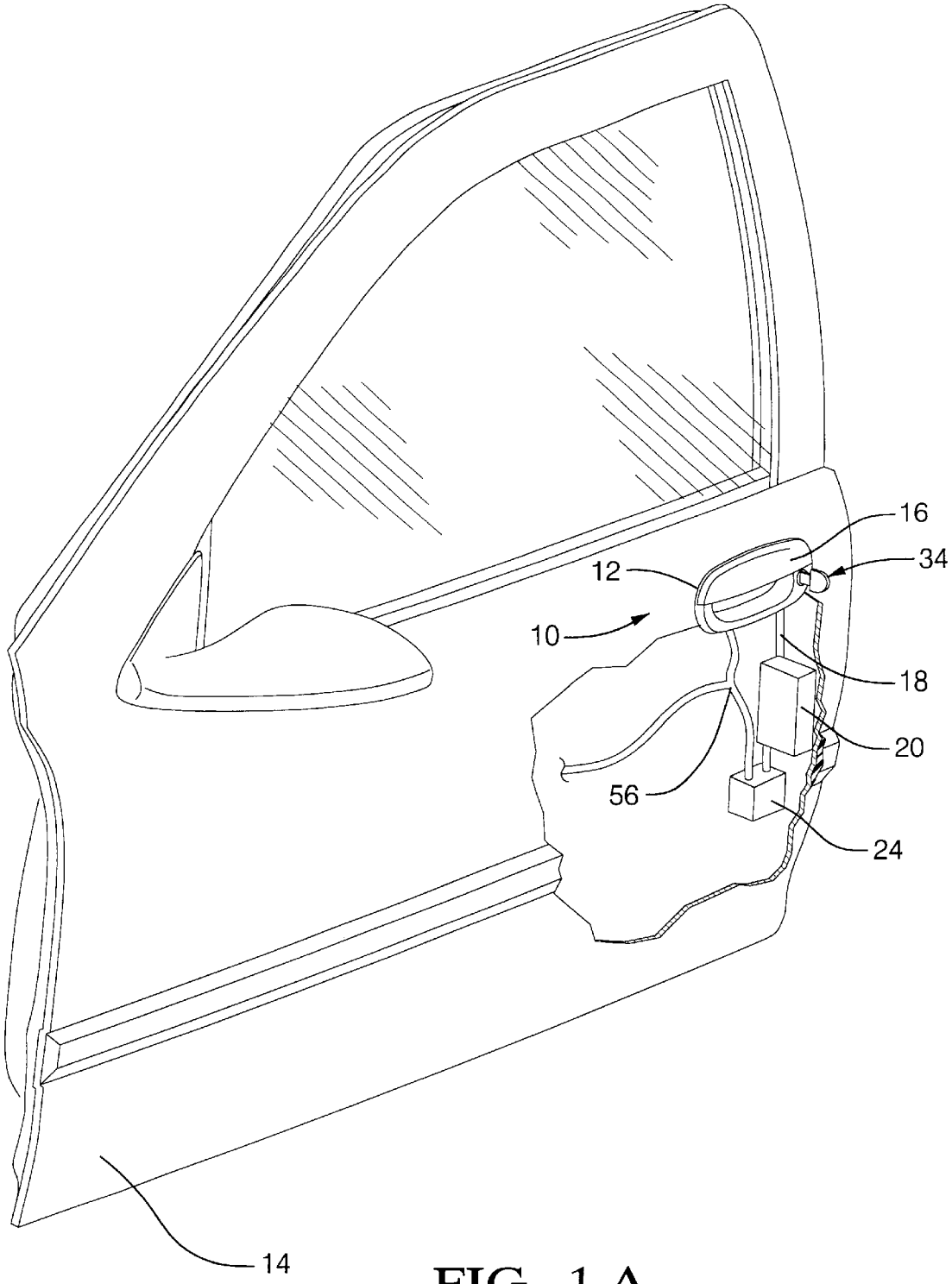
FIG. 1A is a perspective view of a front door of a passenger vehicle showing an embodiment of the latch handle assembly in its environment.
Figure 1B:
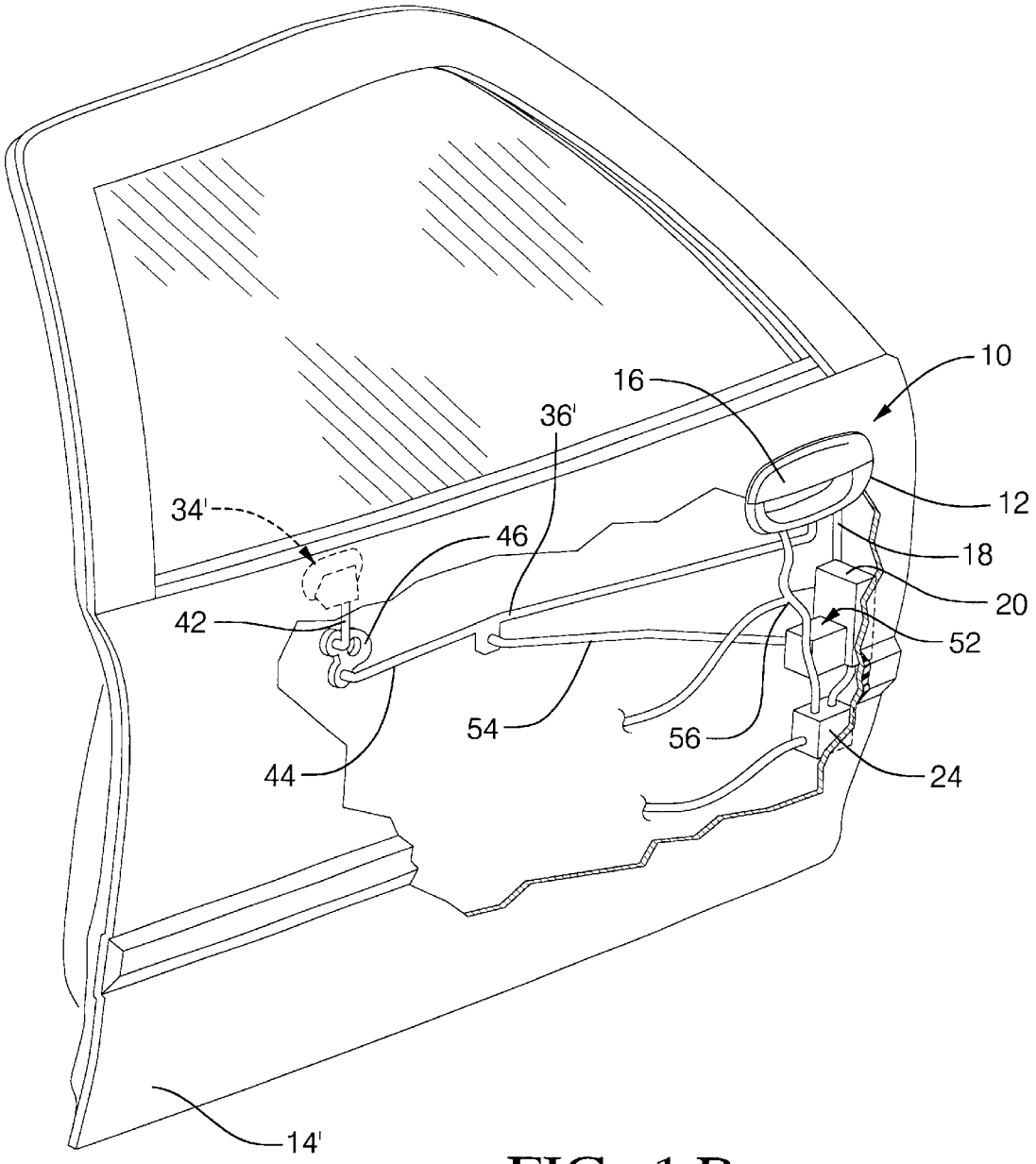
FIG. 1B is a perspective view of a rear door of a passenger vehicle showing another embodiment of the latch handle assembly in its environment.
Figure 2:
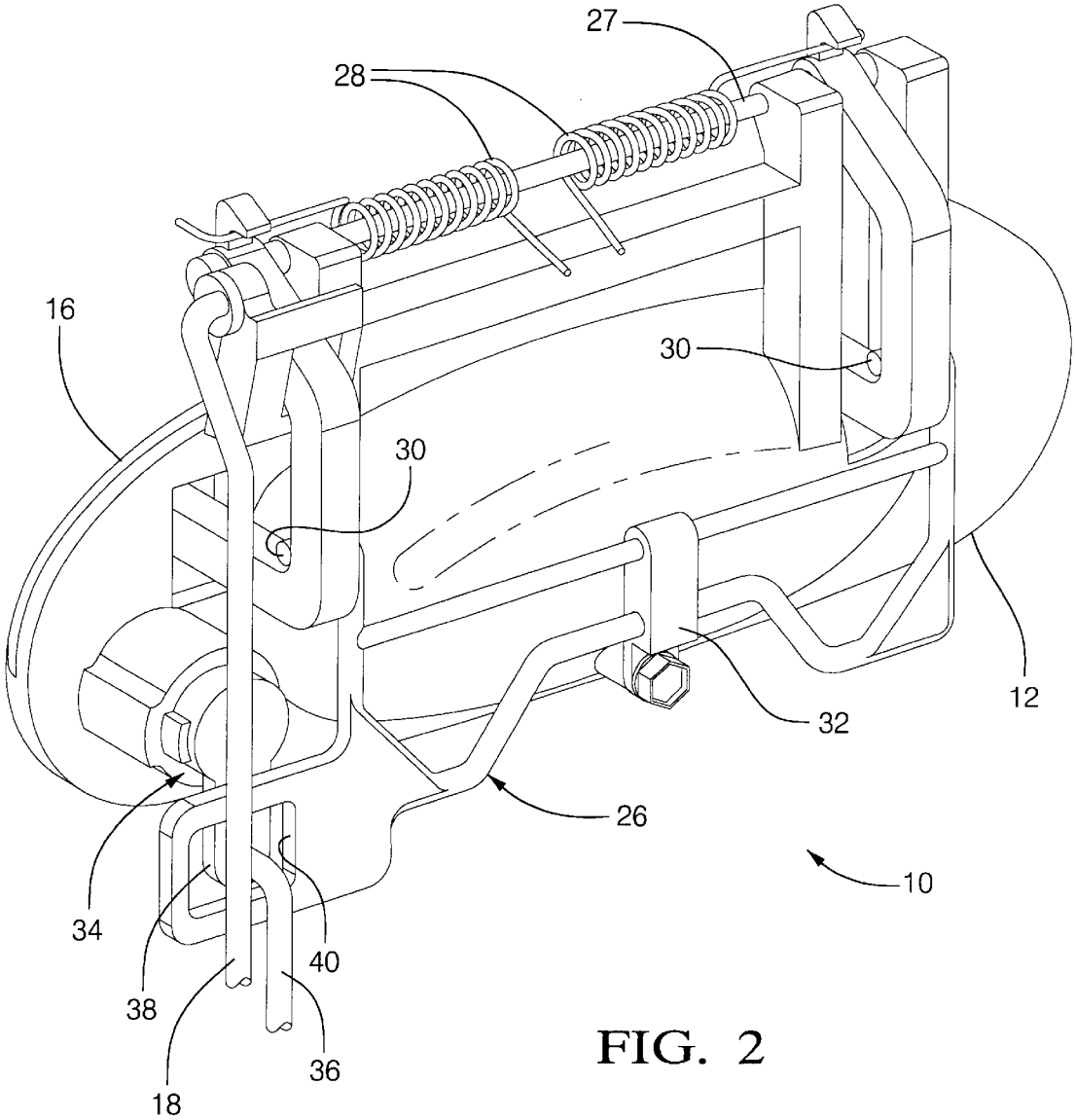
FIG. 2 is a rear perspective view of the latch handle assembly shown in FIG. 1A with the idle lock in the locked position.

Referring to the Figures wherein like numerals indicate like or corresponding parts throughout the several views, a latch handle assembly for a vehicle door is generally shown at 10.

According to the invention, the latch handle assembly 10 includes the following basic features. First, there is a support structure 12 adapted to attach to a vehicle door 14, 14' and a latch handle 16 for manual unlatching of the vehicle door pivotally supported on the support structure 12 between a neutral position and a manual unlatching position. A mechanical linkage 18 is attached to the latch handle 16 and is adapted to interconnect with the door latch 20 for translating motion from the latch handle 16 to a door latch 20 to unlatch the door 14, 14' when the latch handle moves to the unlatching position. The latch handle assembly 10 also includes a switch 22 disposed on the latch handle 16 that is operable to move from a rest position to a power-unlatching position. The switch 22 is adapted to interconnect with a power-assisted unlatching mechanism 24 to allow the switch 22 to unlatch the door latch 20 when the switch moves to the power-unlatching position. Finally, there is a handle lock generally indicated at 26 disposed adjacent the latch handle. The handle lock 26 is operative to move from a locked position preventing the latch handle 16 from moving to the manual unlatching position, and an unlocked position allowing movement of the latch handle 16 to the manual unlatching position.

The support structure is shown at 12 in the Figures. In the preferred embodiment, it is essentially the frame that supports the latch handle 16. But the support structure 12 could be other structure that provides the supporting function.

The latch handle 16 is a standard type of latch handle that is hinged at the top with hinge 27, though side hinging or bottom hinging is also possible. A spring assembly 28 disposed near the hinge 27 biases the latch handle 16 into the neutral position.

The handle lock 26 includes at least one pin 30 operable to engage the latch handle 16 when the handle lock 26 is in the locked position to prevent movement of the latch handle 16 relative to the support structure 12. There are obviously many ways for the pin 30 to engage the latch handle 16 and prevent it from moving. Any of these ways falls within the scope of the invention. One such way might involve disposing the pin 30 between the latch handle 16 and the support structure 12 so that the pin 30 engages the latch handle 16 only when an operator attempts to move the latch handle. This pin 30 still "engages" the latch handle 16 within the scope of the invention. Preferably, the handle lock 26 includes first and second (i.e. at least two) pins 30. A pin linkage 32 interconnects the first and second pins 30 as shown in the figures. The pin linkage 32 causes the pins 30 to move simultaneously.

The handle lock 26 also includes an actuator generally indicated at 34, 34' interconnected with the pin linkage 32. The actuator 34, 34' moves the pins 30 from an engaged position wherein the pins 30 engage the latch handle 16, to a disengaged position wherein the pins 30 do not engage the latch handle 16. The specific form of the actuator 34, 34' will depend on which door 14, 14' is involved—front or back.

The handle lock 26 also includes an actuator linkage 36, 36' interconnecting the actuator 34, 34' and the pin linkage 32. The specific form of the actuator linkage 36, 36' depends on which door 14, 14' is involved.

In one case, the actuator is a key cylinder assembly 34 disposed adjacent the latch handle 16. This is shown in FIGS. 1A and FIGS. 2–6. This arrangement is of course preferable in the case of front doors 14. The key cylinder 34 is operative to move from a first position corresponding to the engaged position of the pins 30, and a second position corresponding to the disengaged position. In other words, the key cylinder 34 causes the pins 30 to move when it moves. When it moves to the first position, the pins 30 move into the engaged position. When it moves to the second position, the pins 30 move into the disengaged position. As shown in the Figures, the actuator linkage for this embodiment includes the rod 36 extending from a tab 38 located on the back side of the key cylinder. The rod 36 interconnects with a slot 40 defined in the pin linkage 32. Thus, when a person manipulates the key cylinder 34, the rod 36 will move the pin linkage 32, and thus the pins 30, into or out of engagement with the latch handle 16.

Figure 4:
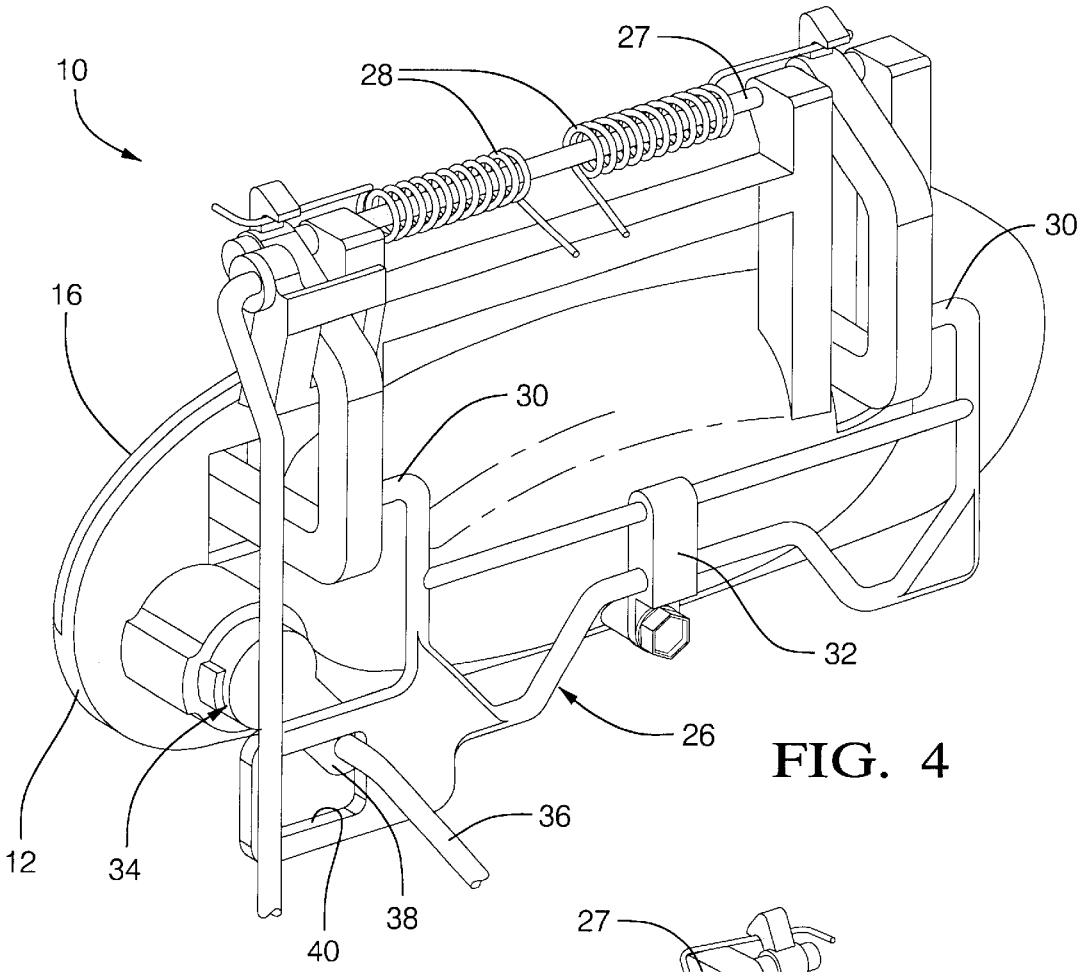
FIG. 4 is a rear perspective view of the latch handle assembly shown in FIG. 1A with the handle lock in the unlocked position.
Figure 5A:
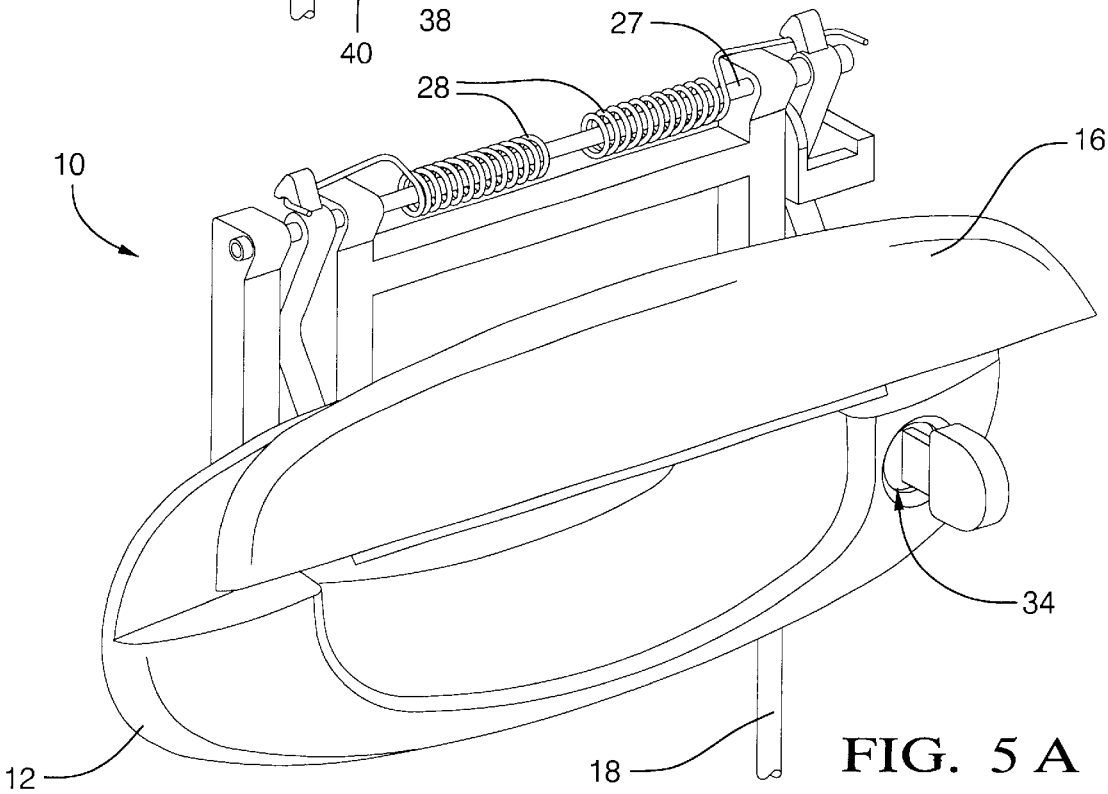
FIG. 5A is a front perspective view of the latch handle assembly shown in FIG. 1A with the latch handle in the manual unlatching position.
Figure 5B:
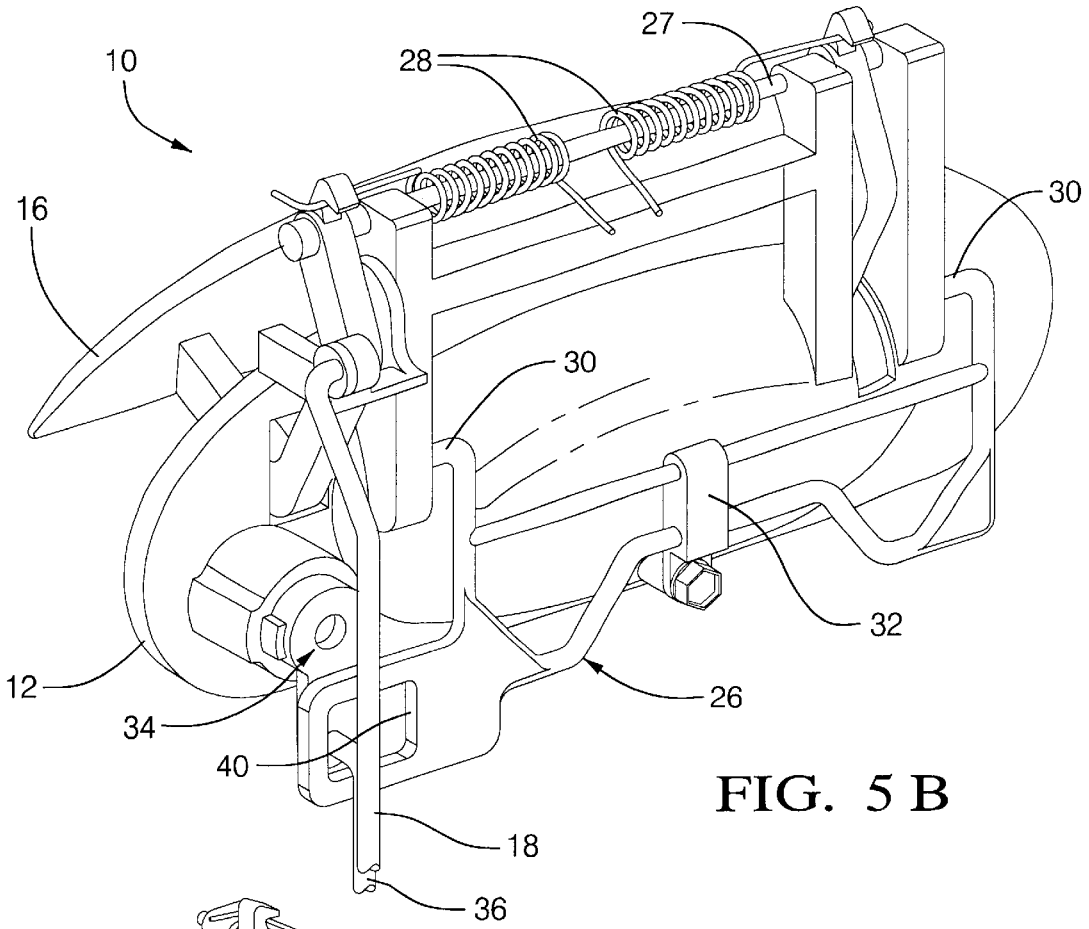
FIG. 5B is a rear perspective view of the latch handle assembly shown in FIG. 1A with the latch handle in the manual unlatching position.
Figure 6:
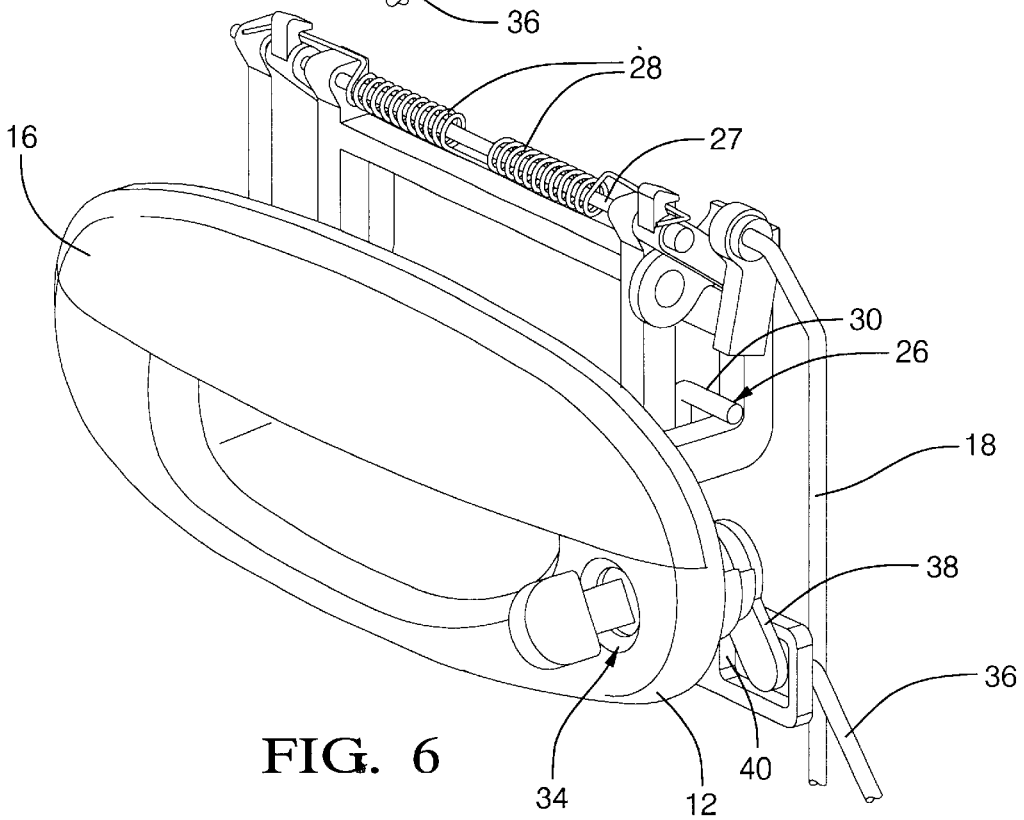
FIG. 6 is a front perspective view of the latch handle assembly shown in FIG. 1A with the handle lock returned to the locked position.
Figure 7:
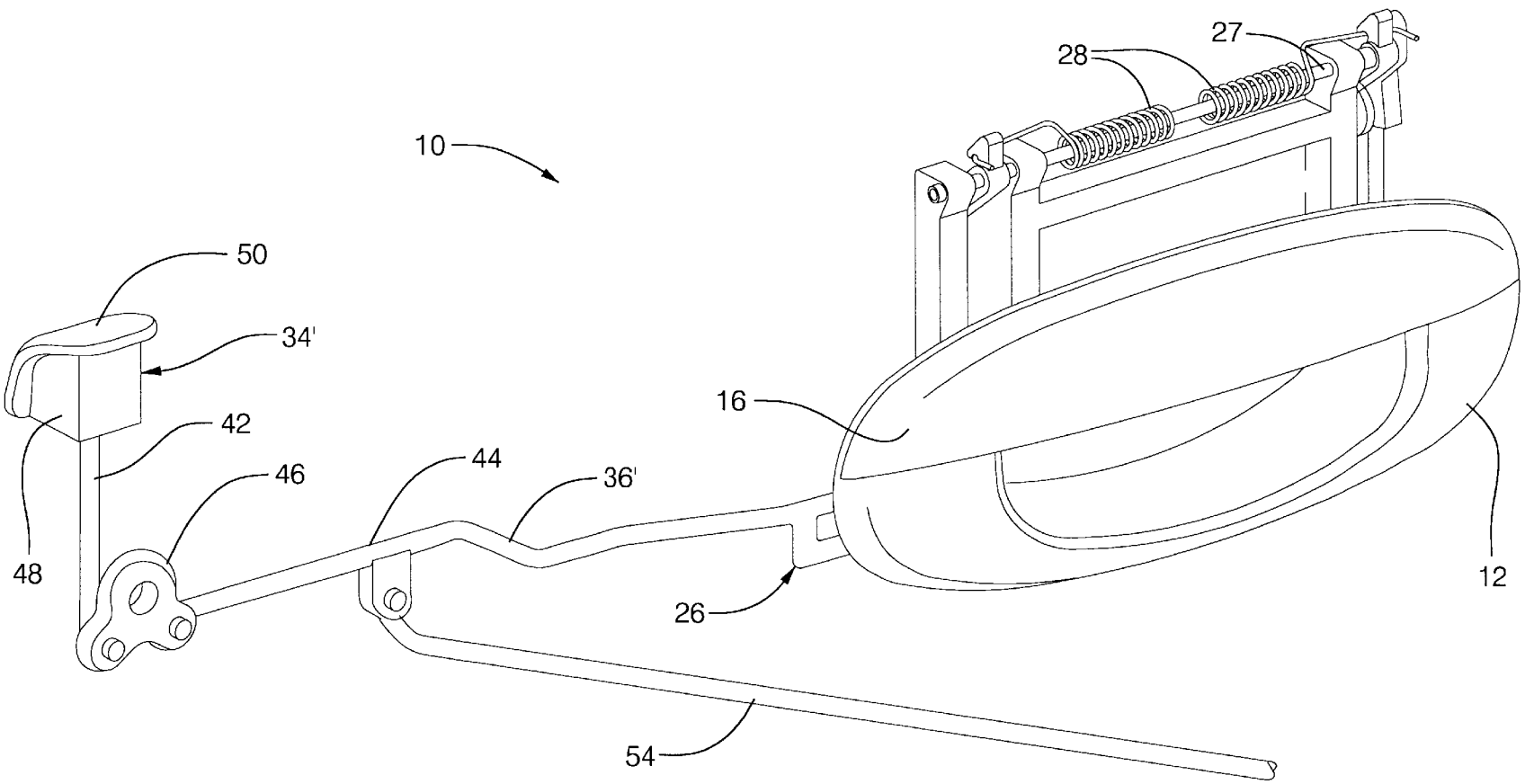
FIG. 7 is a front perspective view of the latch handle assembly shown in FIG. 1B with the handle lock in the locked position.
Figure 8:
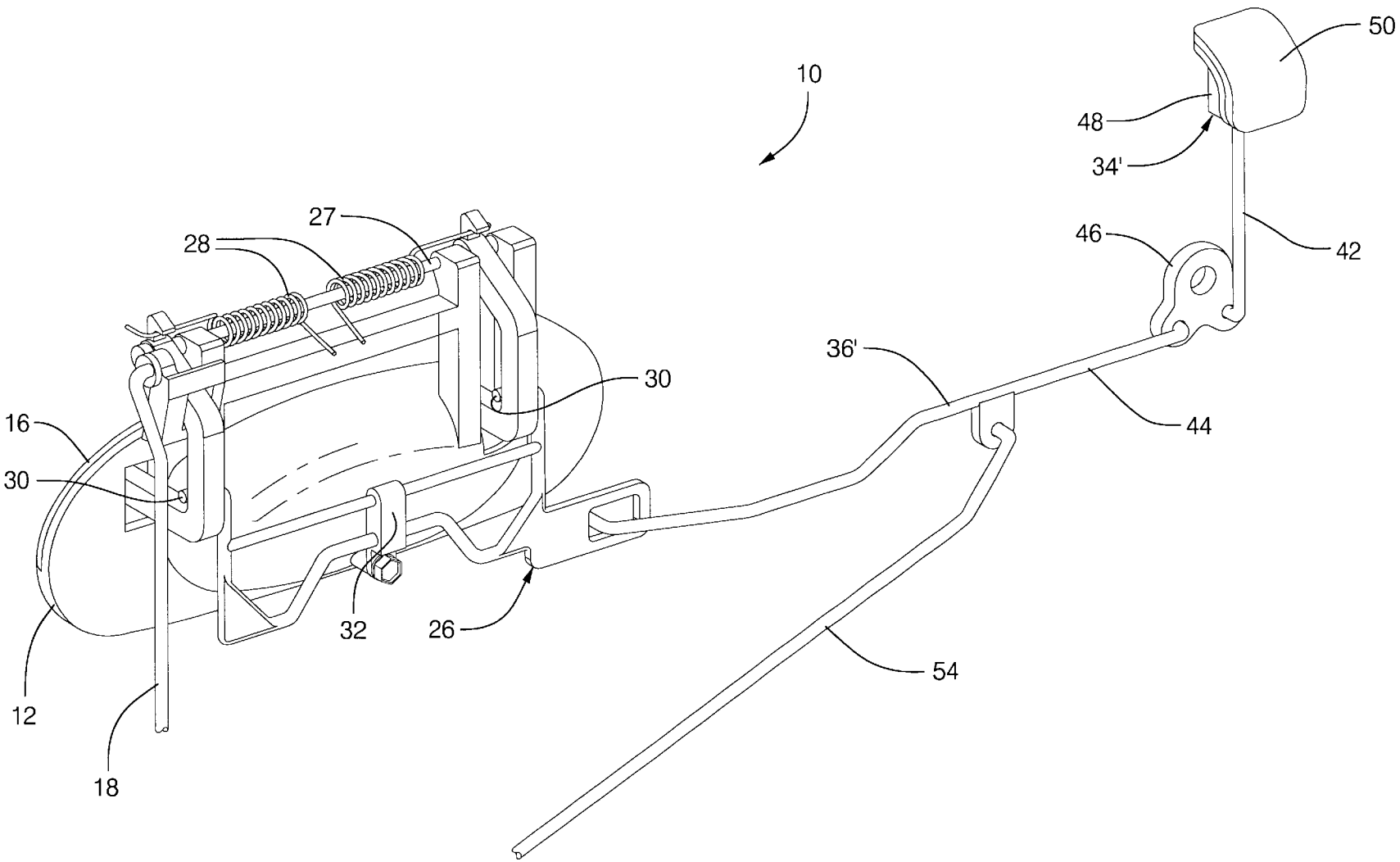
FIG. 8 is a rear perspective view of the latch handle assembly shown in FIG. 1B with the handle lock in the locked position.
Figure 9:
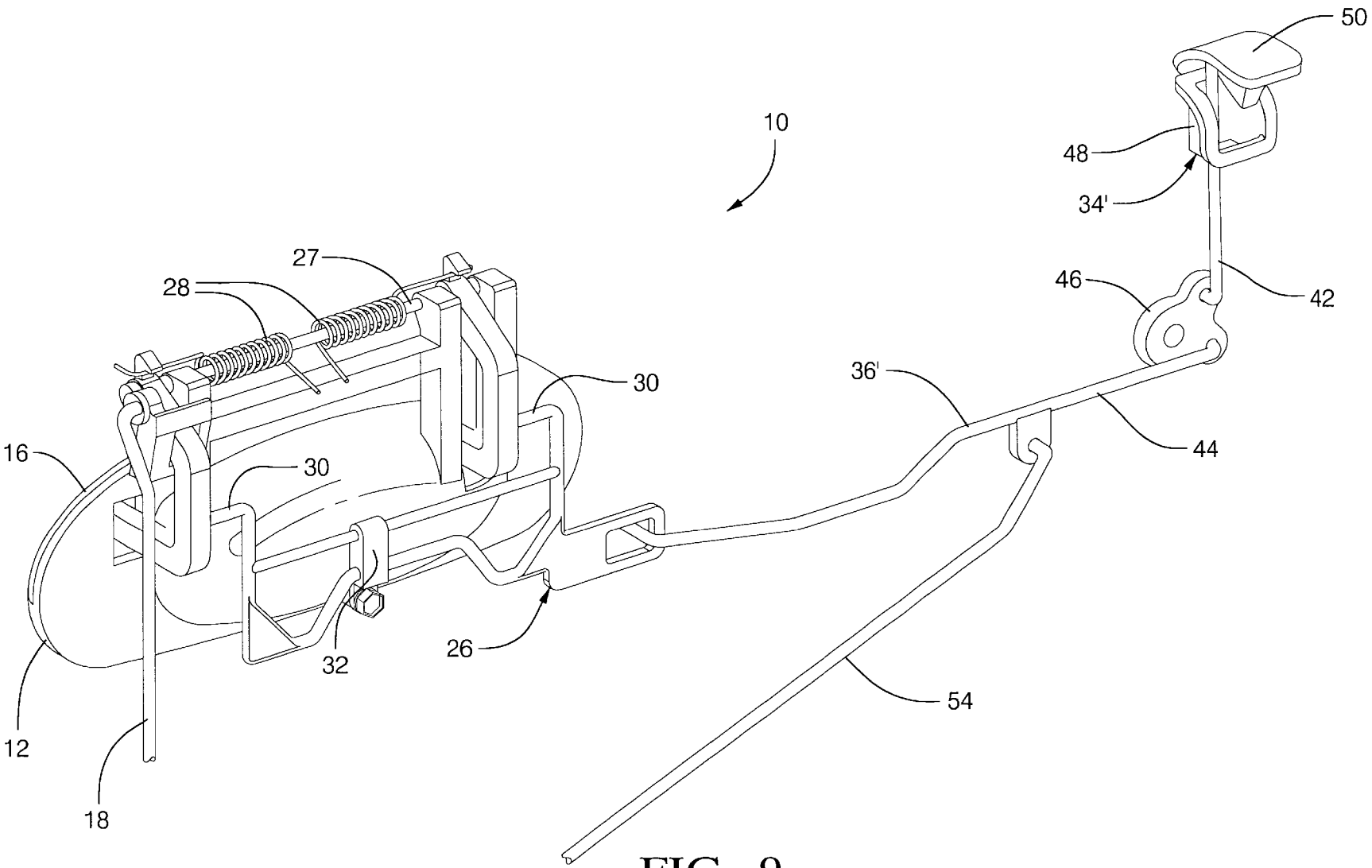
FIG. 9 is a rear perspective view of the latch handle assembly shown in FIG. 1B with the handle lock drawn into the unlocked position by the sill flap.
Figure 10:
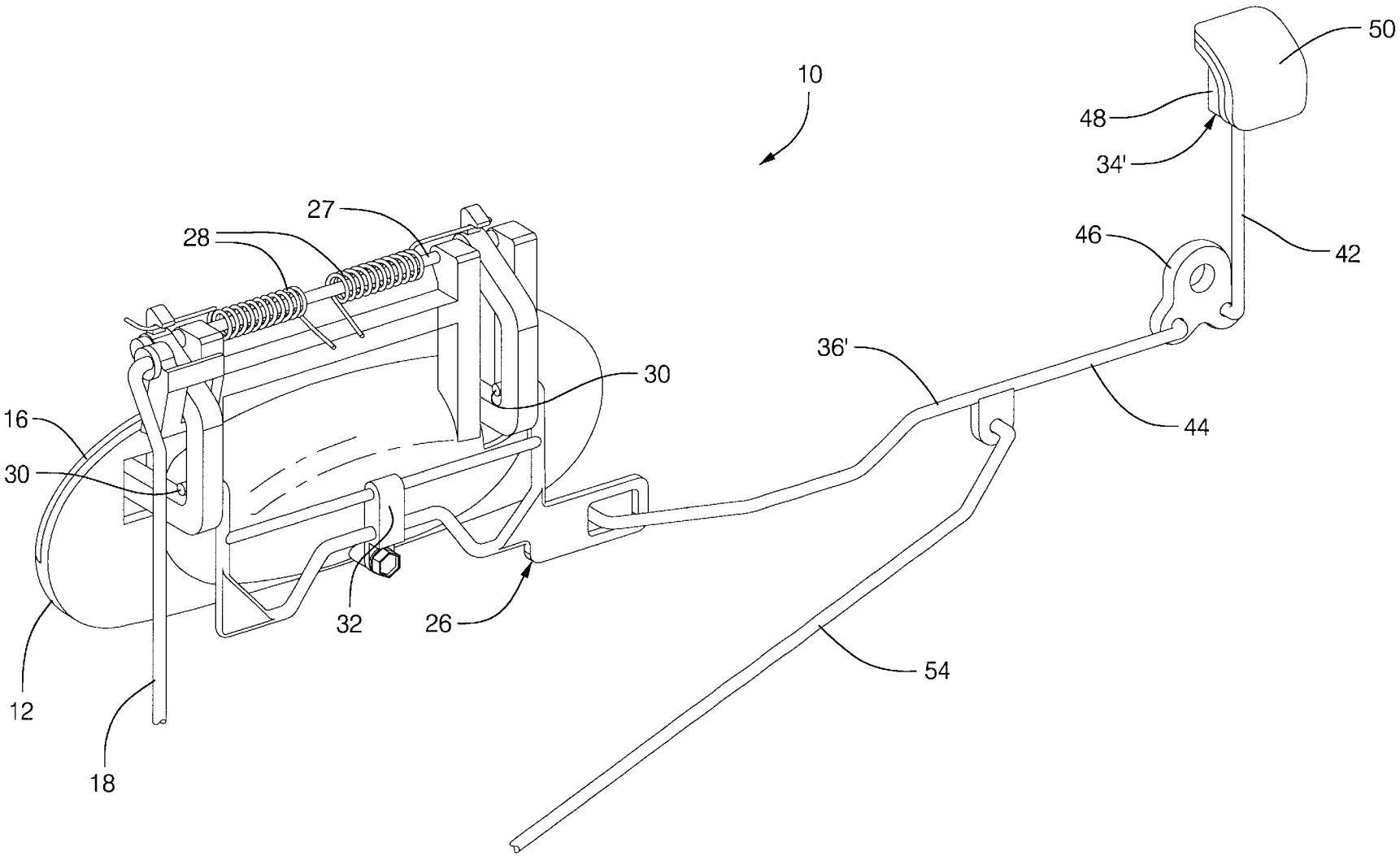
FIG. 10 is a rear perspective view of the latch handle assembly shown in FIG. 1B with the handle lock returned to the locked position.

For example, FIG. 4 shows the key cylinder 34 rotated to move the rod 36, which in turn moves the pin linkage 32 so that the pins 30 disengage the latch handle 16. This allows the latch handle 16 to move as shown in FIGS. 5A and 5B. In order to move the pins 30 back into engagement with the latch handle 16, the key cylinder 34 is manipulated in the other direction, as shown in FIG. 6.

In another case, the actuator is a sill actuator assembly 34' disposed remote from the latch handle 16 and adapted to be installed on the inside sill of the vehicle door 14'. This is shown in FIGS. 1B and FIGS. 7–10. This version of the assembly is suitable for a back door 14', and is preferred for back doors needing the child security function. In this case the assembly includes an elongated sill linkage 36' interconnecting the pin linkage 32 and the sill actuator 34'.

The sill linkage 36' includes at least first and second rods 42, 44 interconnected by a bell crank 46. The bell crank 46 pivotally attaches to a support structure on the door 14' to translate vertical motion into horizontal motion. The sill actuator 34' includes a flap support 48 that can be installed on the inside sill of the vehicle door 14'. The sill actuator 34' also includes a flap 50 pivotally mounted on the flap support 48, the flap 50 being operative to move from a first position corresponding to the engaged position of the pins 30, and a second position corresponding to the disengaged position of the pins.

At least this back door version of the latch handle assembly 10 includes a power locking actuator assembly generally indicated at 52 interconnected with the pin linkage 32 (directly or indirectly) for moving the pins 30 to the engaged position. The power locking actuator 52 includes a power locking linkage 54 interconnected (indirectly) with the pin linkage 32. Specifically, the power locking linkage 54 is attached to the sill linkage 36', which in turn is attached to the pin linkage 32. The power locking actuator itself 52 is shown generally in FIG. 1B. The specific type of power locking actuator 52 used is not critical to the invention. The purpose of the power locking actuator assembly 52 is to move the pins 30 back into the engaging position when power is restored. The power locking actuator 52 further draws the sill flap 50 back down. According to one possibility, the power locking actuator 52 is a common power actuator sold by Delphi Automotive systems under the designation PL400. Exactly how the power locking actuator 52 is actuated is a matter of design choice. One possibility is to actuate it with a button or switch located near the driver. Another possibility is to have automatic actuation controlled by an on-board computer. Any of these or other possibilities are within the skill of persons in the art to implement.

Figure 3A:
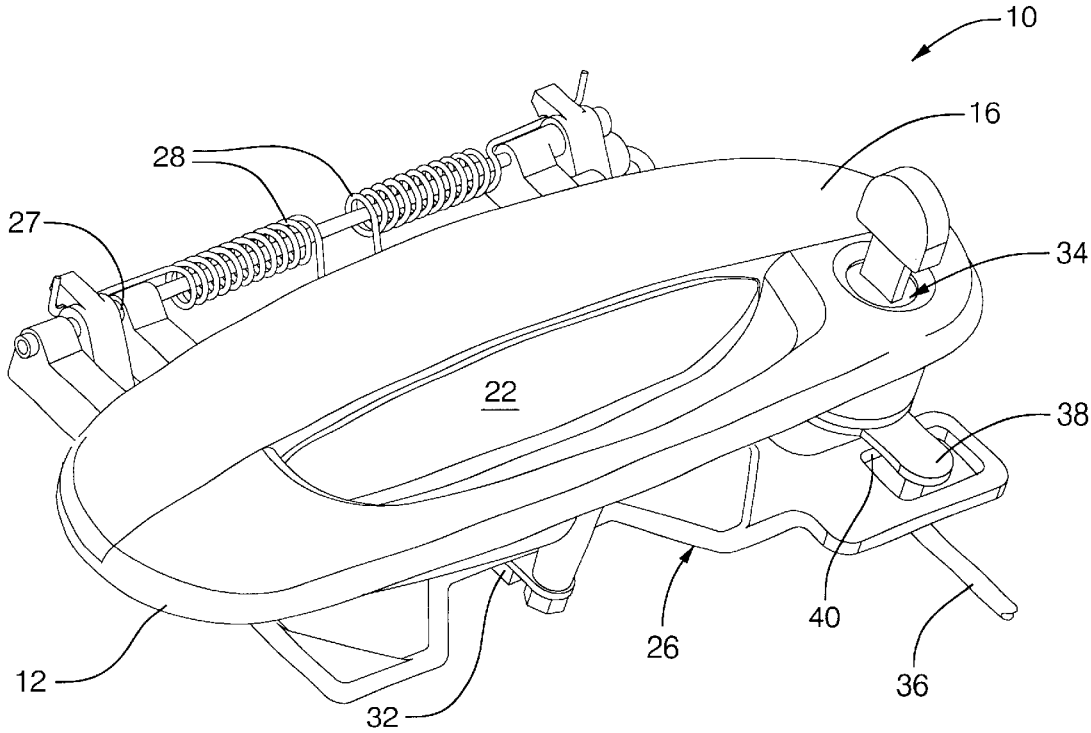
FIG. 3A is a lower front perspective view of the latch handle assembly shown in FIG. 2 with the switch in the rest position.
Figure 3B:
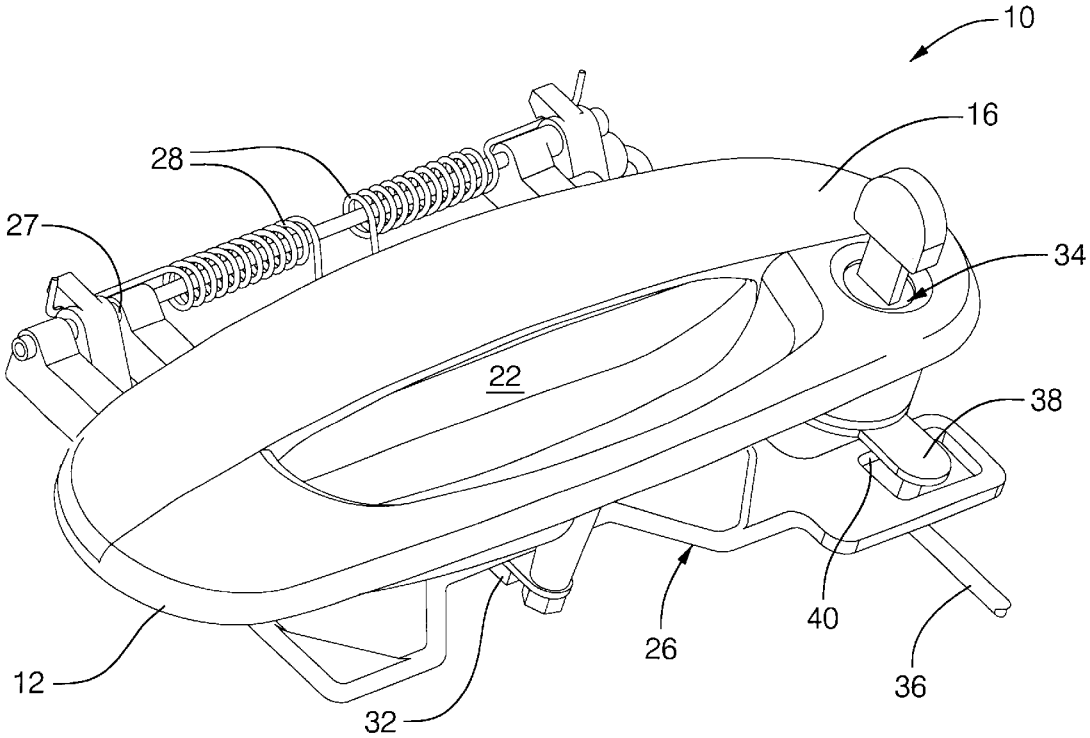
FIG. 3B is a lower front perspective view of the latch handle assembly shown in FIG. 2 with the switch in the power-unlatching position.

In either version or embodiment of the latch handle assembly 10, the switch 22 is a flap pivotally mounted on the back side of the latch handle 16 as best shown in FIGS. 3A and 3B. The switch 22 can easily be manipulated under normal operating conditions simply by pushing on it with one or more fingers. When the operator depresses the switch 22 as shown in FIG. 3B, this will unlatch the door via a circuit that controls a power mechanism 24. The circuit is only partially shown at 56 in FIGS. 1A and B. This power mechanism 24 is commercially available from Delphi Automotive Systems under the designation PL300. Any suitable mechanism will suffice.

In either version or embodiment of the latch handle assembly 10, the mechanical linkage 1I interconnects with the latch 20, and specifically with a fork bolt detent inside the latch. The exact nature of this mechanical linkage 18 is not critical, and indeed it can vary widely depending on the type of latch used. In the present case, the latch 20 is of the type made and sold by Delphi Automotive Systems. It is also the subject of several United States patents, including U.S. Pat. No. 4,756,563 granted to Stephen L. Garwood and Jeffrey Konchan, Jul. 12, 1988 for a vehicle door latch; and U.S. Pat. No. 5,054,827 granted to Jeffrey L. Konchan and Jiri Paulik, Oct. 8, 1991 for a vehicle door latch.

According to a different conception of the invention, there is a vehicle door assembly comprising several components. First is a supporting structure (not the "support structure" previously discussed) having an inside surface and an oppositely-facing, spaced-apart outside surface. This supporting structure is preferably the door frame and the sheet metal comprising the door 14, 14'. A latch 20 is supported on the supporting structure 14, 14' and is operable to move from a latched position to an unlatched position. At least one switch 22 is disposed on the supporting structure 14, 14' and is operative to control the latch 20. An electromechanical power unlatching assembly 24 is disposed on the supporting structure 14, 14' and interconnects with the latch 20 and the switch 22 and is operative to unlatch the latch 20 in response to manipulation of the switch 22. A manual latch handle 16 is disposed on the outside surface of the support structure 14, 14' and is operable to move from a neutral position to an unlatching position. A mechanical linkage 18 interconnects the latch handle 16 and the latch and is operative to move the latch to the unlatched position in response to manipulation of the latch handle. Finally, a handle lock 26 is associated with the latch handle 16, and is operative to move from a locked position in which the handle lock 26 prevents motion transfer from the latch handle 16 to the latch 20, and an unlocked position in which the handle lock permits the motion transfer.

According to either conception of the invention, the normal operation of the door latch assembly 10 is by means of the switch 22. The switch 22 operates the power unlatching mechanism 24, which unlatches the latch 20 to open the door. In this normal operating condition, the handle lock 26 is locked and the latch handle 16 cannot move. If for any reason the power unlatching function does not work, a person can still unlatch the door 14, 14' through manual unlatching. First, the person unlocks the handle lock 26 by either manipulating the key cylinder 34 (in the case of the front door), or by manipulating the sill flap 34' (in the case of the rear door). This allows the latch handle 16 to pivot and thus manually unlatch the door latch 20 via the mechanical linkage 18.

In the case of the back door 14', the latch handle assembly 10 would be disposed on the outside of the door. The inside of the door 14' would have some type of power unlatching switch (not shown) and the sill flap 50. The inside would not include a manual unlatching latch handle. Under unlocked circumstances, a person could unlatch the door 14' from the inside by operating the power unlatching switch. In child security situations, the driver could switch off power to the rear door power unlatching switch, so that the rear door could only be opened by operating the switch 22 on the latch handle assembly 10 disposed on the outside of the door 14'. In the event of a power failure, one could still open the rear door by first pulling the sill flap 50 up. This unlocks the latch handle 16 to allow manual unlatching of the door from the outside. When power is restored, the power locking actuator 52 draws the sill flap 50 back down and repositions the pins 30 in the engaging position.

We claim:

1. A latch handle assembly for use in connection with a vehicle door latch that is unlatched manually and with an electric, power-assisted unlatching mechanism, the latch handle assembly comprising:

a support structure adapted to attach to a vehicle door;

a latch handle for manual unlatching of the vehicle door pivotally supported on the support structure for movement between a neutral position and a manual unlatching position;

a mechanical linkage attached to the latch handle and adapted to interconnect with the door latch for translating motion from the latch handle to the door latch to unlatch the door when the latch handle moves to the unlatching position;

an exposed switch moveably mounted on the latch handle operable to move from a rest position to a power-unlatching position, the switch being adapted to interconnect with the power-assisted unlatching mechanism to allow the switch to unlatch the door when the switch moves to the power-unlatching position; and a handle lock disposed adjacent the latch handle operative to move from a locked position preventing the latch handle from moving to the manual unlatching position, and an unlocked position allowing movement of the latch handle to the manual unlatching position.

2. A latch handle assembly for use in connection with a vehicle door latch that is unlatched manually and with an electric, power-assisted unlatching mechanism, the latch handle assembly comprising:

a support structure adapted to attach to a vehicle door;

a latch handle for manual unlatching of the vehicle door pivotally supported on the support structure for movement between a neutral position and a manual unlatching position;

a mechanical linkage attached to the latch handle and adapted to interconnect with the door latch for translating motion from the latch handle to the door latch to unlatch the door when the latch handle moves to the unlatching position;

a switch disposed on the latch handle operable to move from a rest position to a power-unlatching position, the switch being adapted to interconnect with the power-assisted unlatching mechanism to allow the switch to unlatch the door when the switch moves to the power-unlatching position; and a handle lock disposed adjacent the latch handle operative to move from a locked position preventing the latch handle from moving to the manual unlatching position, and an unlocked position allowing movement of the latch handle to the manual unlatching position, the handle lock including at least one pin operable to engage the latch handle when the handle lock is in the locked position to prevent movement of the latch handle relative to the support structure.

3. The latch handle assembly of claim 2 wherein the handle lock includes first and second pins.

4. The latch handle assembly of claim 3 wherein the handle lock includes a pin linkage interconnecting the first and second pins.

5. The latch handle assembly of claim 4 wherein the handle lock includes an actuator interconnected with the pin linkage operative to move the pins from an engaged position wherein the pins engage the latch handle, to a disengaged position wherein the pins do not engage the latch handle.

6. The latch handle assembly of claim 5 wherein the handle lock includes an actuator linkage interconnecting the actuator and the pin linkage.

7. The latch handle assembly of claim 6 wherein the actuator is a key cylinder assembly disposed adjacent the latch handle, the key cylinder being operative to move from a first position corresponding to the engaged position of the pins, and a second position corresponding to the disengaged position.

8. The latch handle assembly of claim 6 wherein the actuator is a sill actuator assembly disposed remote from the latch handle and adapted to be installed on the inside sill of the vehicle door.

9. The latch handle assembly of claim 8 further including an elongated sill linkage interconnecting the pin linkage and the sill actuator.

10. The latch handle assembly of claim 9 wherein the sill actuator includes a flap support adapted to be installed on the inside sill of the vehicle door, and a flap pivotally mounted on the flap support, the flap being operative to move from a first position corresponding to the engaged position of the pins, and a second position corresponding to the disengaged position of the pins.

11. The latch handle assembly of claim 5 including a power locking actuator assembly interconnected with the pin linkage for moving the pins to the engaged position.

12. The latch handle assembly as set forth in claim 11 wherein the power locking actuator assembly includes a power locking linkage interconnected with the pin linkage.

13. The latch handle assembly as set forth in claim 11 wherein the power locking linkage is attached to the sill linkage.

14. The latch handle assembly as set forth in claim 1 wherein the switch is a flap pivotally mounted on the back side of the latch handle.

15. A vehicle door assembly comprising:

a supporting structure having an inside surface and an oppositely-facing, spaced-apart outside surface;

a latch supported on the supporting structure operable to move from a latched position to an unlatched position;

an exposed switch disposed on the supporting structure and operative to control the latch;

an electromechanical power unlatching assembly disposed on the supporting structure and interconnected with the latch and the switch operative to unlatch the latch in response to manipulation of the switch;

a manual latch handle disposed on the outside surface of the supporting structure and operable to move from a neutral position to an unlatching position;

mechanical linkage interconnecting the latch handle and the latch and operative to move the latch to the unlatched position in response to manipulation of the latch handle; and a handle lock associated with the latch handle and operative to move from a locked position in which the handle lock prevents motion transfer from the latch handle to the latch, and an unlocked position in which the handle lock permits the motion transfer.

16. The vehicle door as defined in claim 15 wherein the handle lock includes at least one pin operable to engage the latch handle when the handle lock is in the locked position to prevent movement of the latch handle relative to the support structure.

17. The vehicle door of claim 16 wherein the handle lock includes first and second pins.

18. The vehicle door of claim 17 wherein the handle lock includes a pin linkage interconnecting the first and second pins.

19. The vehicle door of claim 18 wherein the handle lock includes an actuator interconnected with the pin linkage operative to move the pins from an engaged position wherein the pins engage the latch handle, to a disengaged position wherein the pins do not engage the latch handle.

20. The vehicle door of claim 19 wherein the handle lock includes an actuator linkage interconnecting the actuator and the pin linkage.

21. The vehicle door of claim 20 wherein the actuator is a key cylinder assembly disposed adjacent the latch handle, the key cylinder being operative to move from a first position corresponding to the engaged position of the pins, and a second position corresponding to the disengaged position.

22. The vehicle door of claim 20 wherein the actuator is a sill actuator assembly disposed remote from the latch handle and adapted to be installed on the inside sill of the vehicle door.

23. The vehicle door of claim 22 further including an elongated sill linkage interconnecting the pin linkage and the sill actuator.

24. The vehicle door of claim 23 wherein the sill actuator includes a flap support adapted to be installed on the inside sill of the vehicle door, and a flap pivotally mounted on the flap support, the flap being operative to move from a first position corresponding to the engaged position of the pins, and a second position corresponding to the disengaged position of the pins.

25. The vehicle door latch handle assembly of claim 19 including a power locking actuator assembly interconnected with the pin linkage for moving the pins to the engaged position.

26. The vehicle door as set forth in claim 25 wherein the power locking actuator assembly includes a power locking linkage interconnected with the pin linkage.

27. The vehicle door as set forth in claim 25 wherein the power locking linkage is attached to the sill linkage.

28. The vehicle door as set forth in claim 15 wherein the switch is a flap pivotally mounted on the back side of the latch handle.

* * * * *